US005618209A

United States Patent [19]

Lin et al.

[11] Patent Number: 5,618,209

[45] Date of Patent: Apr. 8, 1997

[54] FUSE BOX

[76] Inventors: Kuang T. Lin; Shih-Tsung Liang, both of No. 10, Lane 31, Ta-Feng St., Lu-Chu Hsiang, Taoyuan County, Taiwan

[21] Appl. No.: 540,482

[22] Filed: Oct. 10, 1995

[51] Int. Cl.[6] ..... H01R 13/68

[52] U.S. Cl. ..... 439/621

[58] Field of Search ..... 439/621, 622, 439/830–833; 337/186, 194, 195

[56] References Cited

U.S. PATENT DOCUMENTS

| | | | |
|---|---|---|---|
| 5,116,246 | 5/1992 | Perry et al. | 439/621 |
| 5,167,541 | 12/1992 | Alves et al. | 439/622 |
| 5,328,392 | 7/1994 | Lin et al. | 439/621 |

*Primary Examiner*—Gary F. Paumen
*Attorney, Agent, or Firm*—Morton J. Rosenberg; David I. Klein

[57] ABSTRACT

A cartridge fuse box which includes a bottom shell covered with a cover shell and having a holder frame, a plurality of terminal blocks respectively mounted in respective horizontal holes on the holder frame to hold a respective conductor by a respective tightening-up screw and a respective metal socket by a respective screw for permitting the conductors to be respectively connected to the metal sockets, a fuse connector fixedly secured to the bottom shell remote from the holder frame to hold a plurality of metal sockets by a respective screw, a plurality of cartridge fuses connected between the metal sockets of the fuse connector and the metal sockets of the terminal blocks, and a plurality of clamps respectively mounted in the holder frame to hold down the conductors of the terminal blocks.

1 Claim, 5 Drawing Sheets

FUSE BOX

BACKGROUND OF THE INVENTION

The present invention relates to fuse boxes, and relates more particularly to a cartridge fuse box which holds a plurality of cartridge fuses connected between conductors.

FIGS. 4, 5, and 6 show a cartridge fuse box according to the prior art which is comprised of a bottom shell 5, a cover shell 51 covered on the bottom shell 5, a fuse connector 6 and a set of terminal blocks respectively fixed to the bottom shell 5 at two opposite sides, a plurality of tightening-up screws 63 and 73 respectively fastened to the fuse connector 6 and the terminal blocks to hold down conductors, a plurality of curved metal spring plates 61 and 71 respectively fixed to the fuse connector 6 and the terminal blocks 7 by screws 62 and 72, and a plurality of cartridge fuses 8 connected between the curved metal spring plates 61 on the fuse connector 6 and the metal spring plates 71 on the terminal blocks 7. This structure of cartridge fuse box is still not satisfactory in function. Because the cartridge fuses 8 are supported between the curved metal spring plates 61 and 71, they tend to displace when the cartridge fuse box is vibrated, thereby causing a contact error or the occurrence of electric sparks. Therefore, this structure of cartridge fuse box is not safe in use.

SUMMARY OF THE INVENTION

The present invention has been accomplished to provide a cartridge fuse box which eliminates the aforesaid problem. According to the preferred embodiment of the present invention, the cartridge fuse box comprises a bottom shell covered with a cover shell and having a holder frame for holding a plurality of cartridge fuses, the holder frame comprising a plurality of horizontal holes disposed in a parallel relation, and a plurality of vertical top holes respectively communicating the horizontal holes; a plurality of terminal blocks respectively mounted in the horizontal holes to hold a respective conductor by a respective tightening-up screw, each terminal block having a metal socket at one end fixedly:secured in place by a screw to hold one end of a respective cartridge fuse; a plurality of clamps respectively mounted in the vertical top holes of the holder frame to hold down the conductor of each terminal block; and a fuse connector fixed to the bottom shell remote from the holder frame to hold the opposite end of each cartridge fuse, the fuse connector comprising a plurality of metal sockets fixedly secured in place by a respective screw to hold the cartridge fuses.

DETAILED DESCRIPTION OF THE PREFERRED EMBODIMENT

Figure 1:
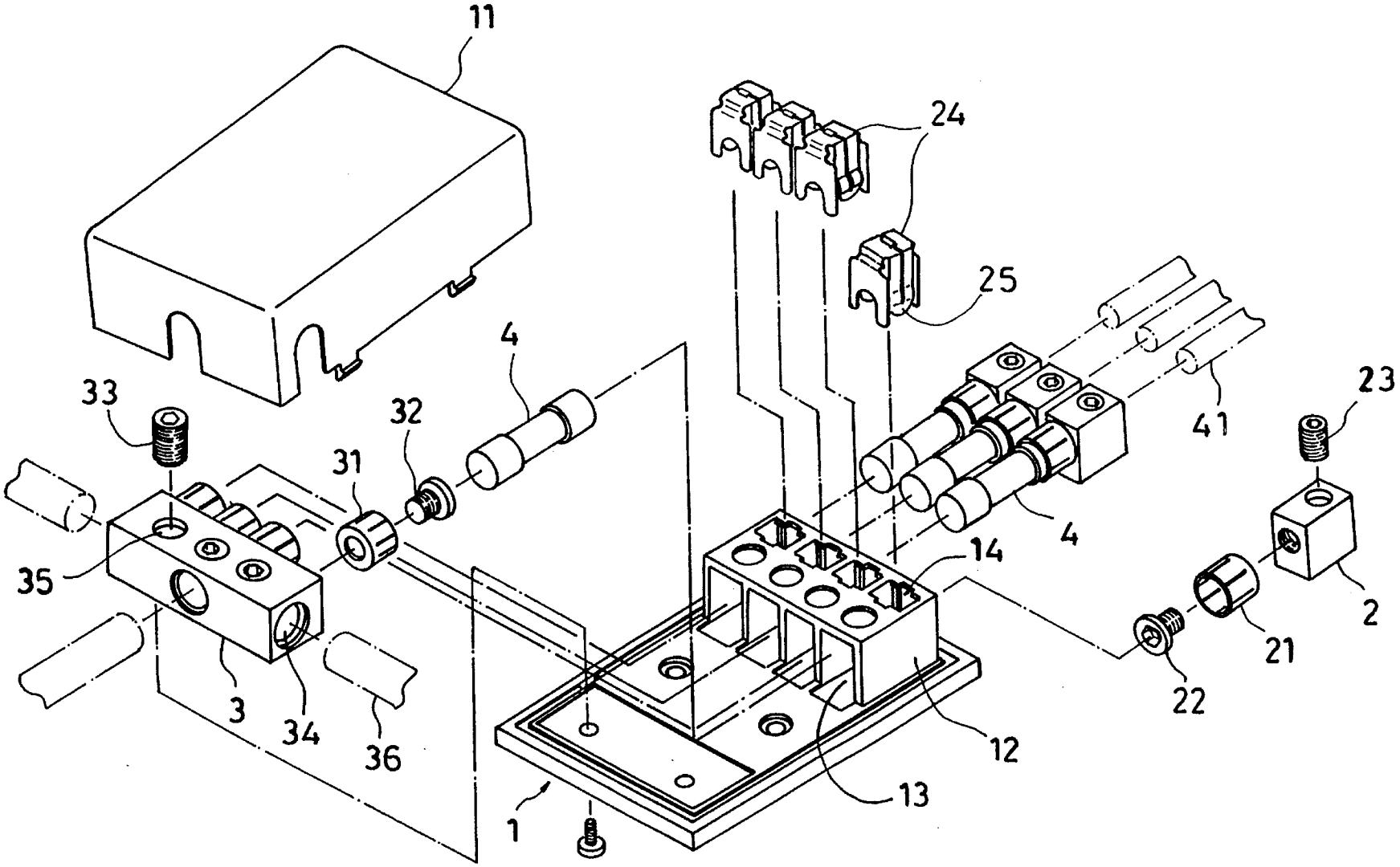
FIG. 1 is an exploded view of a fuse box according to the present invention.
Figure 2A:
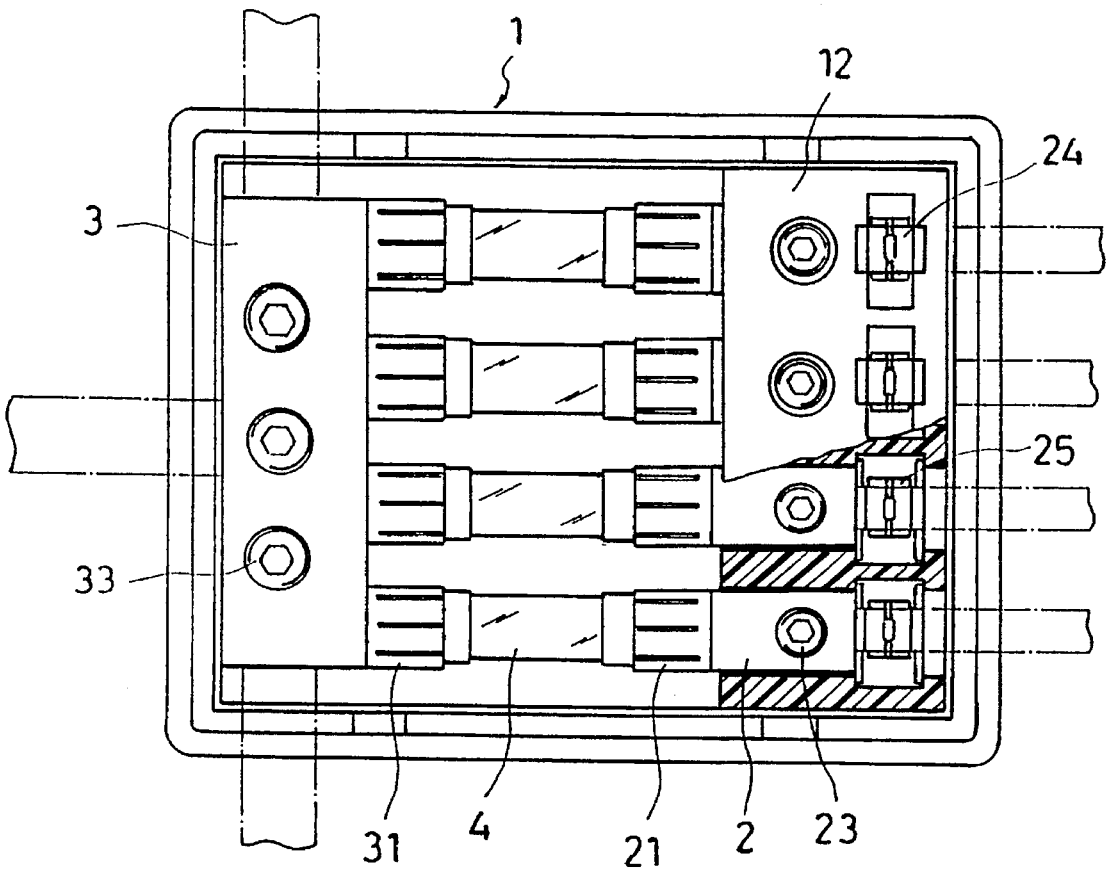
FIG. 2A is a top view in section of the fuse box shown in FIG. 1.
Figure 2B:
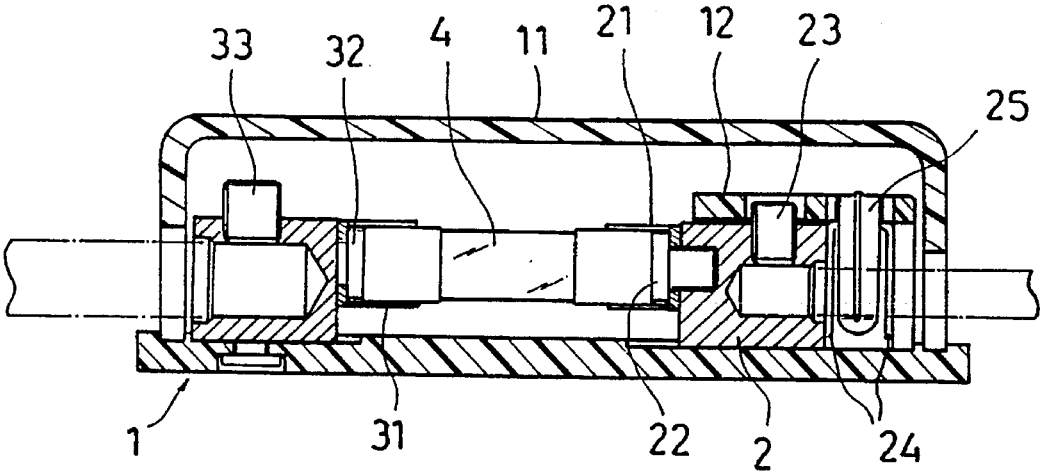
FIG. 2B is a side view in section of the fuse box shown in FIG. 1.
Figure 3A:
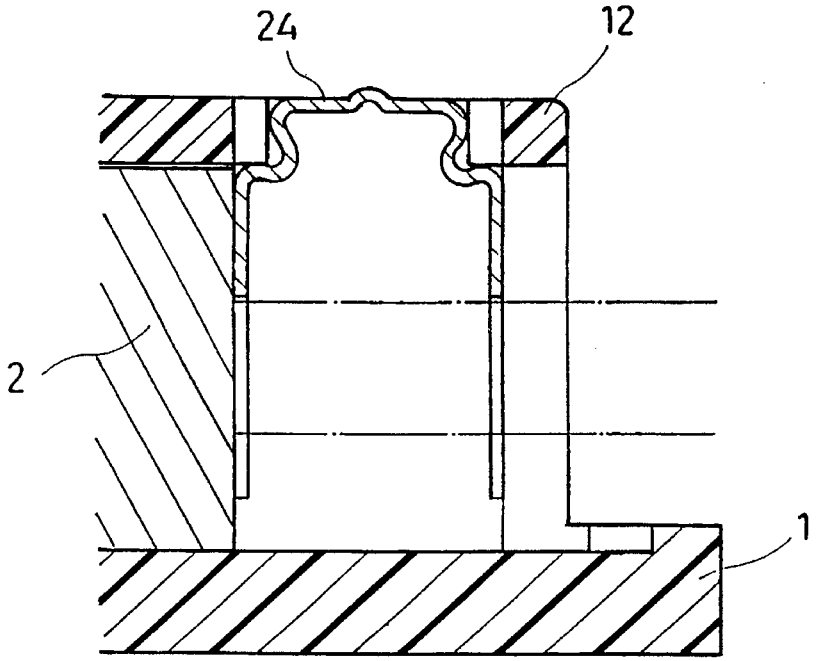
FIG. 3A is a partial view in an enlarged scale of FIG. 2B, showing the positioning of the clamp in the holder frame.
Figure 3B:
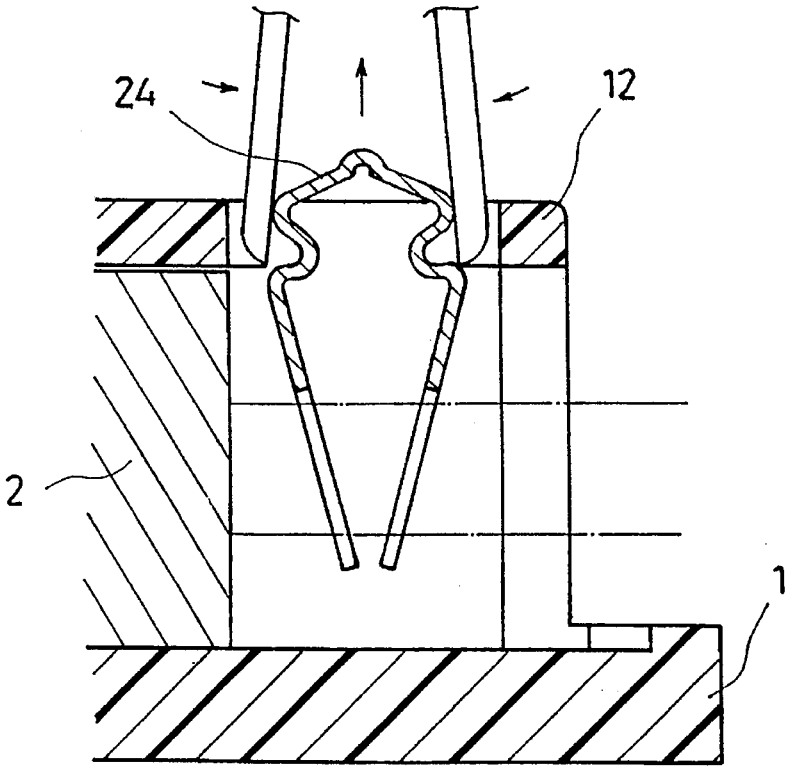
FIG. 3B is similar to FIG. 3A but showing the clamp compressed and removed from the holder frame.
Figure 4:
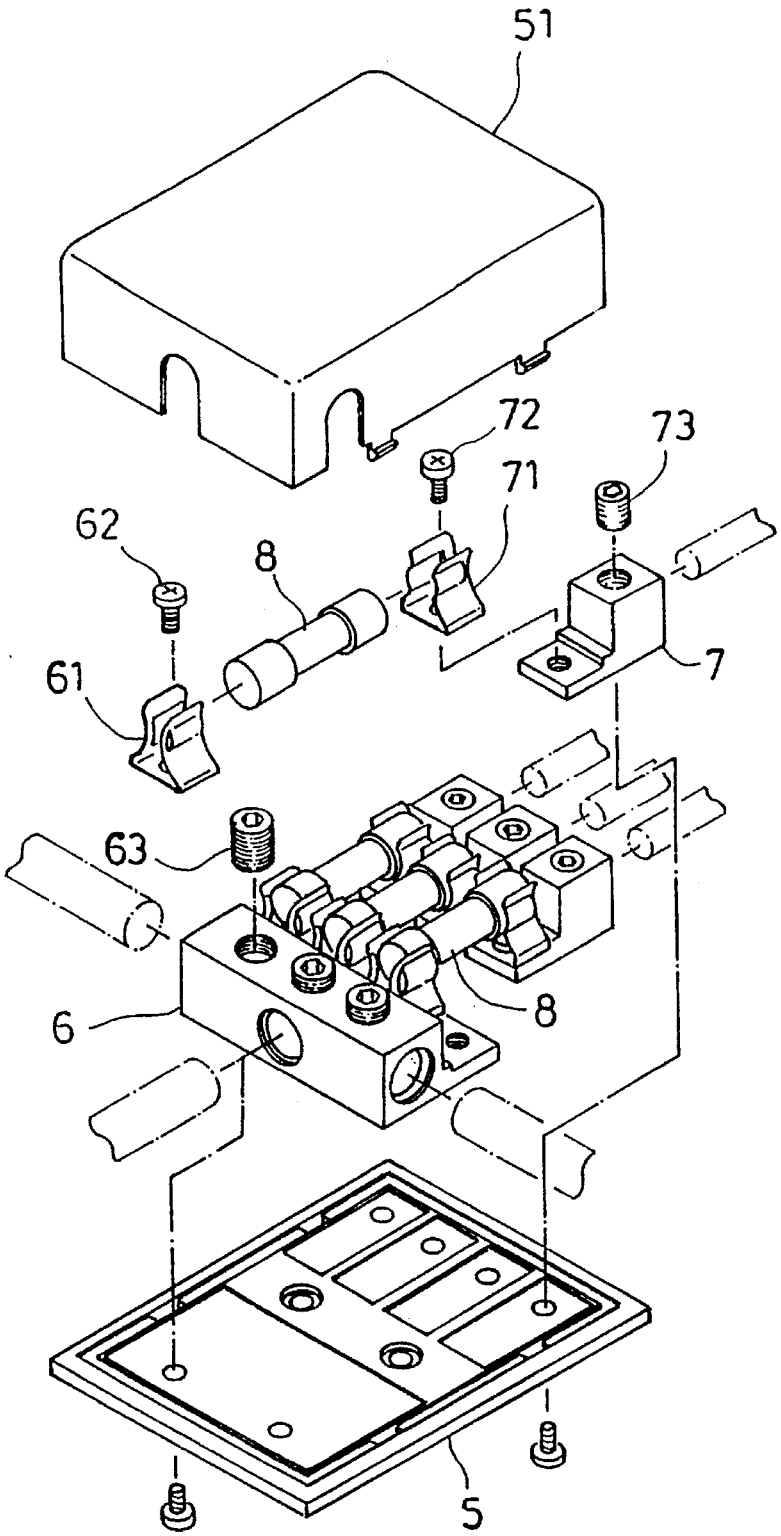
FIG.4 PRIOR ART
FIG. 4 is an exploded view of a fuse box according to the prior art.
Figure 5:
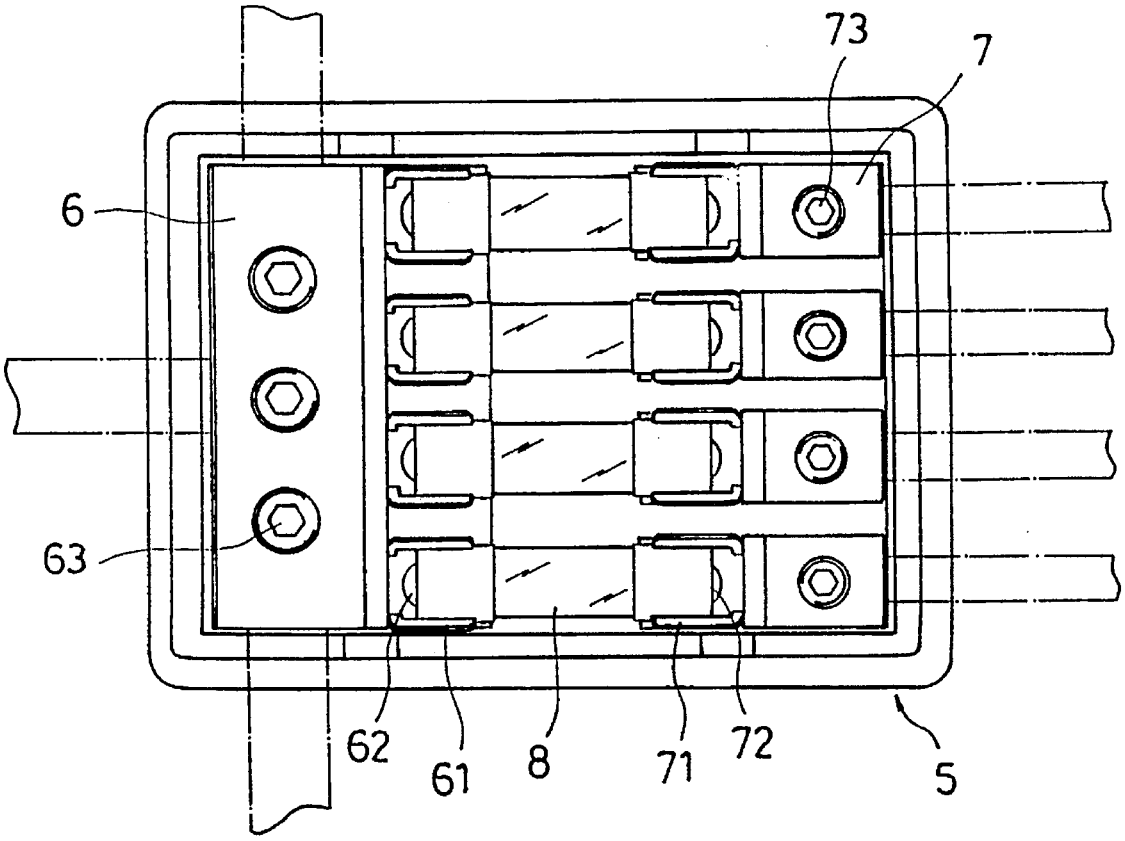
FIG.5 PRIOR ART
FIG. 5 is a top view in section of the fuse box shown in FIG. 4.
Figure 6:
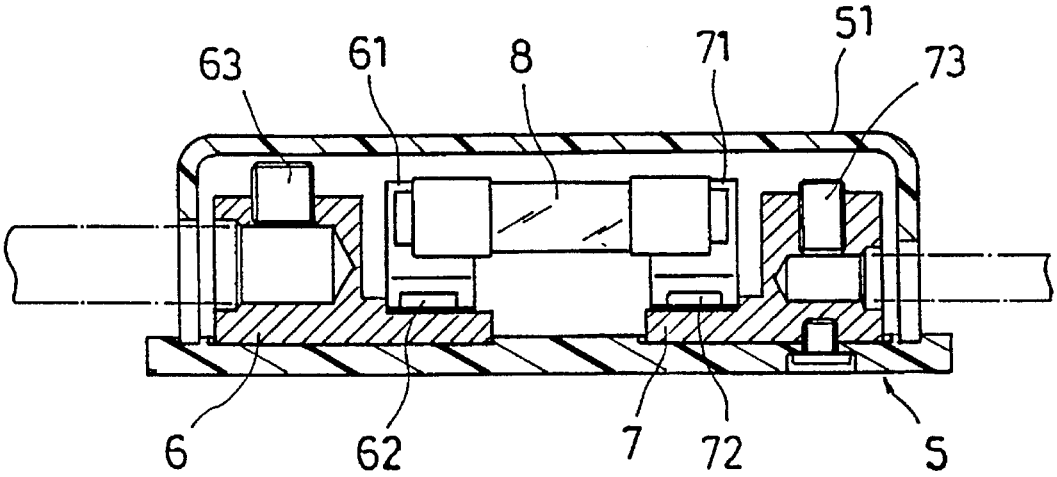
FIG.6 PRIOR ART
FIG. 6 is a side view in section of the fuse box shown in FIG. 4.

Referring to FIGS. 1, 2A, 2B, 3A, and 3B, a fuse box in accordance with the present invention is generally comprised of a bottom shell 1 and a cover shell 11 covered on the bottom shell 12. The bottom shell 1 comprises a holder frame 12 for holding a plurality of cartridge fuses 4. The holder frame 12 comprises a plurality of horizontal holes 13 disposed in a parallel relation, and a plurality of vertical top holes 14 respectively communicating the horizontal holes 13. A plurality of terminal blocks 2 are respectively mounted in the horizontal holes 13 to hold a respective conductor 41 by a respective tightening-up screw 23. Each of the terminal blocks 2 has one end (opposite to the corresponding conductor 41) mounted with a metal socket 21 by a screw 22 for holding one cartridge fuse 4. A plurality of clamps 24 are respectively mounted in the vertical top holes 14 to hold down the conductors 41 respectively. Each of the clamps 24 has a mouth 25 for holding down the respective conductor 41. A fuse connector 3 is fixed to the bottom shell 1 remote from the holder frame 12 for holding the opposite ends of the cartridge fuses 4. The fuse connector 3 has a plurality of horizontal wire holes 34 and a plurality of top screw holes 35 in communication with the horizontal wire holes 34. A plurality of metal sockets 31 are respectively fixed to the fuse connector 3 by a respective screw 32 to hold the opposite ends of the cartridge fuses 4. When conductors 36 are respectively inserted into the wire holes 34, they are respectively connected to the metal sockets 31, and tightening-up screws 33 are respectively threaded into the top screw holes 35 to hold down the conductors 36.

It is to be understood that the drawings are designed for purposes of illustration only, and are not intended as a definition of the limits and scope of the invention disclosed.

We claim:

1. A fuse box comprising:

a horizontal bottom shell covered with a cover shell and having a holder frame for holding a plurality of cartridge fuses, said holder frame comprising a plurality of horizontal holes disposed in a parallel relation, and a plurality of vertical top holes respectively communicating said horizontal holes;

a plurality of terminal blocks respectively mounted in the horizontal holes to hold a respective conductor by a respective tightening-up screw, each terminal block having a metal socket at one end fixedly secured in place by a screw to hold one end of a respective cartridge fuse and preventing said end from being removed in a vertical direction;

a plurality of clamps respectively mounted in the vertical top holes of said holder frame to hold down the conductor of each terminal block; and a fuse connector fixed to said bottom shell remote from said holder frame to hold the opposite end of each cartridge fuse, said fuse connector comprising a plurality of metal sockets fixedly secured in place by a respective screw to hold the other ends of said cartridge fuses and prevent said other ends from being removed in a vertical direction.

* * * * *